United States Patent [19]

Andro et al.

[11] Patent Number: 4,465,127

[45] Date of Patent: Aug. 14, 1984

[54] DEVICE FOR REDUCING THE THERMAL STRESSES IN THE BOTTOM OF A VERTICAL HEAT EXCHANGER

[75] Inventors: Jean Andro, La Celle Saint-Cloud; Alain Charbonnel, Vitry, both of France

[73] Assignee: Stein Industrie, Villacoublay, France

[21] Appl. No.: 257,601

[22] Filed: Apr. 27, 1981

[30] Foreign Application Priority Data

Apr. 29, 1980 [FR] France ..... 80 09634

[51] Int. Cl.[3] ..... F28F 7/00

[52] U.S. Cl. ..... 165/81; 165/134 R; 165/160

[58] Field of Search ..... 165/81, 134; 376/402, 376/405

[56] References Cited

U.S. PATENT DOCUMENTS

| | | | |
|---|---|---|---|
| 3,438,430 | 4/1969 | Kestemont | 376/402 |
| 4,101,377 | 7/1978 | Berniolles et al. | 376/405 |
| 4,140,176 | 2/1979 | Essenbaggers | 165/134 R |

FOREIGN PATENT DOCUMENTS

| | | |
|---|---|---|
| 2713668 | 11/1977 | Fed. Rep. of Germany . |
| 2386798 | 11/1978 | France . |

*Primary Examiner*—William R. Cline
*Assistant Examiner*—John F. McNally
*Attorney, Agent, or Firm*—Oblon, Fisher, Spivak, McClelland & Maier

[57] ABSTRACT

A vertical heat exchanger adapted to be located between a primary liquid alkali metal circuit and a secondary liquid alkali metal circuit in a fast neutron nuclear reactor is disclosed. The exchanger includes an outer sleeve surrounding an annular tubular bundle on an axial conduit for introduction of the secondary liquid alkali metal in the tubes through a chamber provided in the bottom of the exchanger. The bottom of the exchanger is surrounded by an envelope defining a space in which the primary liquid alkali metal circulates between an annular opening provided at the periphery of the tubular plate carrying the tubular bundle and at least one output opening in the bottom of the envelope.

2 Claims, 1 Drawing Figure

DEVICE FOR REDUCING THE THERMAL STRESSES IN THE BOTTOM OF A VERTICAL HEAT EXCHANGER

BACKGROUND OF THE INVENTION

1. Field of the Invention

The present invention relates heat exchangers and more particularly to a device for reducing the thermal stresses in the bottom of a vertical heat exchanger between a primary liquid alkali metal heated in a fast neutron nuclear reactor and a secondary liquid alkali metal, the device including an axial conduit for introduction of the secondary liquid alkali metal, surrounded by a bundle of tubes fixed on a tubular plate, the secondary liquid alkali metal circulating upwardly in the tubes of the bundle and the primary liquid alkali metal circulating downwardly around the tubes of the bundle, and a chamber for supplying the tubes of the bundle, disposed beneath the bundle and the supply conduit, and wherein the bottom of the vertical heat exchanger is surrounded by an envelope defining a space filled with primary liquid alkali metal.

2. Description of the Prior Art

In exchangers of this type, considerable differences in temperature in steady state and in transient state, in the course of starting up and changes in operation occur between the primary liquid alkali metal, generally sodium, leaving the heat exchange tubular bundle, and the secondary liquid alkali metal arriving at the inlet of the tubes of the tubular bundle. This temperature difference is capable of creating considerable thermal stresses in the wall of the lower bottom of the exchanger which may lead to deformations or ruptures.

It has already been proposed to overcome these temperature differences by providing the bottom of the exchanger with a thermal shield, a double wall surrounding the bottom of the exchanger and a shield of liquid alkali metal enclosed between the bottom and the double wall. Such a shield which is sufficiently effective to reduce the differences in temperature, and therefore the thermal stresses, in steady state, is much less so during transient fast states.

SUMMARY OF THE INVENTION

It is therefore an object of the present invention to provide a device for reducing the thermal stresses, which is effective even during transient fast states, while simple and compact.

The device according to the present invention is characterised in that the envelope surrounding the bottom of the chamber for supplying the tubes of the bundle with secondary liquid alkali metal, is provided with at least one opening for exiting of primary liquid alkali metal flowing from the bottom of the tubular bundle, at the level of the periphery of the tubular plate, and an outlet opening in the bottom of the envelope.

The exit opening is preferably annular and disposed at the bottom of the outlet window through which the primary liquid alkali metal is evacuated above the tubular plate.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DETAILED DESCRIPTION OF THE PREFERRED EMBODIMENT

Figure 1:
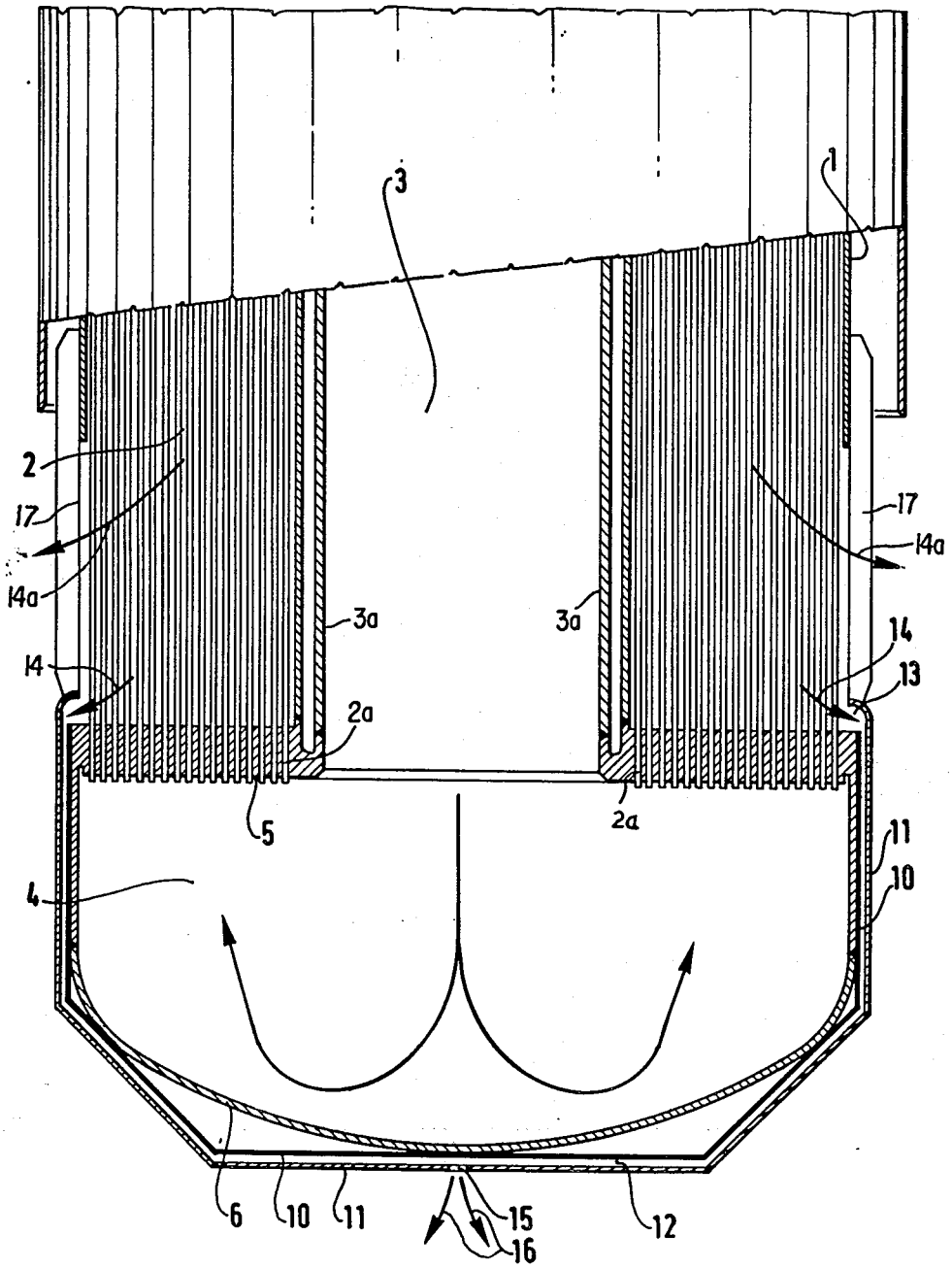
FIG. 1 shows the lower part of an exchanger having primary sodium issuing from a fast neutron nuclear reactor and secondary sodium transmitting the heat to a circuit producing superheated steam under pressure.

The outer sleeve 1, in which primary sodium circulates downwardly, surrounds an annular tubular bundle 2 having a plurality of tubes **2*a* in which secondary sodium circulates upwardly. Secondary sodium introduced through an axial conduit 3 a double envelope 3*a* into a chamber 4 and from the chamber 4 secondary sodium is circulated upwardly through tubes 2*a* of the annular tubular bundle 2 extending into chamber 4 through a lower tubular plate 5. This chamber 4 is defined by the inside surface of a dome-shaped bottom 6. The bottom 6 is surrounded by two parallel sheets 10, 11 defining a space 12 therebetween forming a thermal shield. This space 12 is supplied, via an annular exit opening 13, with primary sodium leaving the tubular bundle 2 in the direction of arrows 14 between a periphery of the tubular plate 5 and the sheet 11. The upper end of the a parallel sheet 11 defines a lower edge of outlet windows 17 for the primary sodium, these windows 17 being formed just above the tubular plate 5 to evacuate the major part of the primary fluid as indicated by the arrows 14*a* in FIG. 1. After having circulated between the sheets 10, 11, the part of the primary sodium taken through opening 13 exits through an axial output opening 15 formed in the bottom of the sheet 11, in the direction of the axis of the exchanger as indicated by arrows 16. This primary sodium circuit, whose particular feature is to take sodium whose temperature remains very close to the temperature of cold secondary sodium, both in steady state and in transient fast state, thereby reduce the thermal gradient layer at the level of the bottom 6-tubular plate 5 joint and the difference in the temperatures between the bottom 6 and the lower tubular plate 5** resulting from the difference in temperature between the cold secondary sodium bathing the inner part of the bottom 6 then passing through the lower tubular plate 5, and the hotter primary sodium bathing the outer part of the bottom 6.

This devices ensures effective thermal protection both in steady state and in transient fast states, on the primary side and secondary side, which would not be the case for a static sodium shield.

Although the device which has been described hereinabove with reference to the drawing appears as the preferred embodiment of the invention, it will be understood that various modifications may be made thereto without departing from the scope of the invention; certain of its elements may be replaced by others which perform a similar technical role.

What is claimed as new and desired to be secured by Letters Patent of the United States is:

1. A device for reducing thermal stresses in a bottom of a vertical heat exchanger caused by a primary liquid metal and a secondary liquid metal, comprising:

a tubular plate affixed near said bottom of said vertical heat exchanger;

a chamber defined by said bottom and said tubular plate;

axial conduit means extending through said vertical heat exchanger to said chamber such that said secondary liquid metal is directed into said chamber through said axial conduit means;

a tubular bundle having a plurality of tubes surrounding said axial conduit means, said tubular bundle being mounted on said tubular plate such that said plurality of tubes extend into said chamber;

said vertical heat exchanger having at least one outlet window formed therein above said tubular plate such that a first portion of said primary liquid metal circulating downwardly around said plurality of tubes is directed through said at least one outlet window to exit said vertical heat exchanger;

inner and outer sheets defining an envelope surrounding said bottom, said inner and outer sheets having a spacing therebetween;

said envelope having at least one exit opening disposed at the bottom of said at least one outlet window such that a second portion of said primary liquid metal circulating downwardly around said plurality of tubes is diverted into said at least one exit opening to circulate in said envelope, wherein said second portion of said primary liquid metal diverted into said at least one exit opening further comprises a liquid metal having a temperature approximately the same as a second temperature of said secondary liquid metal circulating upwardly through said plurality of tubes of said tubular bundle from said chamber such that thermal stresses in said bottom of said vertical heat exchanger are reduced; and said envelope having at least one output opening such that said second portion of said primary liquid circulating in said envelope exits said vertical heat exchanger through said at least one output opening.

2. The device as claimed in claim 1 wherein said exit opening further comprises an annular ring.

* * * * *